United States Patent [19]

Kassanchuk

[11] 4,238,035

[45] Dec. 9, 1980

[54] BABY BOTTLE RACK

[76] Inventor: Jerry N. Kassanchuk, 1312 S. Tyrol Trail, Golden Valley, Minn. 55416

[21] Appl. No.: 942,626

[22] Filed: Sep. 15, 1978

[51] Int. Cl.[3] ..... A47F 5/01

[52] U.S. Cl. ..... 211/74; 211/181

[58] Field of Search ..... 211/74, 106, 181, 41 R, 211/59.1, 71; 248/107; D6/186; D7/69, 71, 188; 224/48 W

[56] References Cited

U.S. PATENT DOCUMENTS

| | | | |
|---|---|---|---|
| D. 162,926 | 4/1951 | Berkowitz | 211/181 UX |
| D. 163,156 | 5/1951 | Zarling | 211/41 X |
| 489,190 | 1/1893 | Groenendyke . | |
| 898,584 | 9/1908 | Labau . | |
| 1,185,677 | 6/1916 | Jargstorf . | |
| 2,553,180 | 5/1951 | Fromme | 211/74 |
| 2,600,755 | 6/1952 | Greensfelder | 211/41 |
| 2,655,267 | 10/1953 | Planeta | 211/74 |
| 2,664,207 | 12/1953 | Bustamante | 211/74 |
| 2,708,037 | 5/1955 | Planeta | 211/74 |
| 2,739,715 | 3/1956 | Planeta | 211/41 |
| 2,864,509 | 12/1958 | Watral | 211/41 |
| 2,879,900 | 3/1959 | Fox | 211/74 |
| 2,957,585 | 10/1960 | Berlener | 211/74 |
| 3,032,203 | 5/1962 | Romero | 211/41 |
| 3,040,901 | 6/1962 | Andrew | 211/71 X |
| 3,124,251 | 3/1964 | Guth | 211/41 |
| 3,167,183 | 1/1965 | Claywell et al. | 211/181 X |
| 3,169,641 | 2/1965 | Chapman | 211/74 |
| 3,181,701 | 5/1965 | Cole | 211/74 |
| 3,200,959 | 8/1965 | Theim | 211/181 X |
| 3,203,557 | 8/1965 | Ettlinger | 211/126 |
| 3,269,548 | 8/1966 | Geiger et al. | 211/41 |
| 3,289,854 | 12/1966 | Kauffman | 211/41 |
| 3,612,285 | 10/1971 | Mason | 211/41 |
| 3,744,646 | 7/1973 | Duncan et al. | 211/162 |
| 3,752,322 | 8/1973 | Fiocca et al. | 211/41 |
| 3,955,682 | 5/1976 | Baren | 211/74 |
| 4,046,261 | 9/1977 | Yake | 211/41 |

*Primary Examiner*—Roy D. Frazier
*Assistant Examiner*—Robert W. Gibson, Jr.
*Attorney, Agent, or Firm*—Merchant, Gould, Smith, Edell, Welter & Schmidt

[57] ABSTRACT

A rack of unitary construction on which can be dried all of the various components of a baby bottle assembly. In the preferred embodiment disclosed, a number of generally vertical rods are provided. A threaded cap can be looped over any one of these rods. The rods also function as prongs over which can be placed inverted bottles and bottle nipples. The preferred embodiment further provides a number of horizontal rods mounted to a series of the generally vertical rods. These horizontal rods define a slit for acceptance of plug discs.

5 Claims, 3 Drawing Figures

BABY BOTTLE RACK

THE BACKGROUND OF THE INVENTION

The present invention relates to racks upon which can be dried different components of an integral assembly. More specifically, it relates to racks upon which can be dried the various components of a baby bottle assembly.

A number of prior devices have been developed upon which can be placed various implements for drying. These devices fall basically into two categories: (1) those which may be used regardless of the nature of the items to be dried and the relationship of those items to each other, and (2) those which were designed for use in drying components of a specific assembly. No prior device within either category has proved satisfactory for drying the various components of a baby bottle assembly.

Because of the relatively small size of some of the baby bottle components, they can easily become separated from the other components of the assembly and be lost. Because of the interrelationship and structural cooperation of the various components of a baby bottle assembly, it is preferable that, while being dried after washing, they be kept in one location. No device upon which bottle components can be dried adequately satisfies the requirements imposed by these two considerations. Some devices would offer one location where the components can be placed, but they fail to consider that some of the baby bottle components are small and can readily be lost. Other structures—those within the second category—provide a method for accepting peculiarly designed small parts of an assembly, but the design of such structures is incompatible with the specific shapes of the various baby bottle components. No one apparatus offered has proved acceptable by meeting all the requirements of a satisfactory baby bottle drying rack.

A particular problem in the prior art is the peculiar shape of the disc plug. Because of its generally flat structure, the plug must frequently be placed on a flat surface for drying. The present invention provides a structure which accepts the plug and all other components of the bottle assembly, maintaining them at some height from the counter on which the device is placed during the drying process.

SUMMARY OF THE INVENTION

The present invention is a rack upon which can be dried all of the various components of a baby bottle assembly. It provides a plurality of generally vertical elongated members. Threaded caps can be looped over these members, and nipples and inverted bottles can be placed over them for draining and complete drying. The rack further includes at least two generally horizontal elongated members. Two of such members define a slot in which plug discs can be placed and held elevated from a horizontal counter on which the rack is placed. The invention of the present application further provides a means for connecting and maintaining a fixed spatial relationship between the generally vertical members and the generally horizontal members. This means integrates the various other elements into a unitary structure and provides that structure with a measure of rigidity.

In a preferred embodiment disclosed, the generally vertical elongated members take the form of rods, said rods being paired by interposing an interconnecting means which joins each of the rods to its mate. In the preferred embodiment the interconnecting means also takes the form of rod, and this rod attaches to the generally vertical rods proximate their bottom ends. A series of generally U-shaped members are thereby formed.

In the embodiment disclosed, the generally horizontal elongated members may also take the form of rods. These rods which define a slot in which plug discs can be placed also serve to rigidly connect the U-shaped members and thereby provide a fixed spatial relationship between all the elements of the rack. Additional members may be provided to increase structural integrity.

The present invention thus is a rack for effecting more efficient drying of all the components of a baby bottle assembly and for maintaining the various components in one location during drying. These and other advantages of the invention will become apparent with reference to the accompanying drawings, detailed description of the preferred embodiment, and claims.

DESCRIPTION OF THE PREFERRED EMBODIMENT

Figure 1:
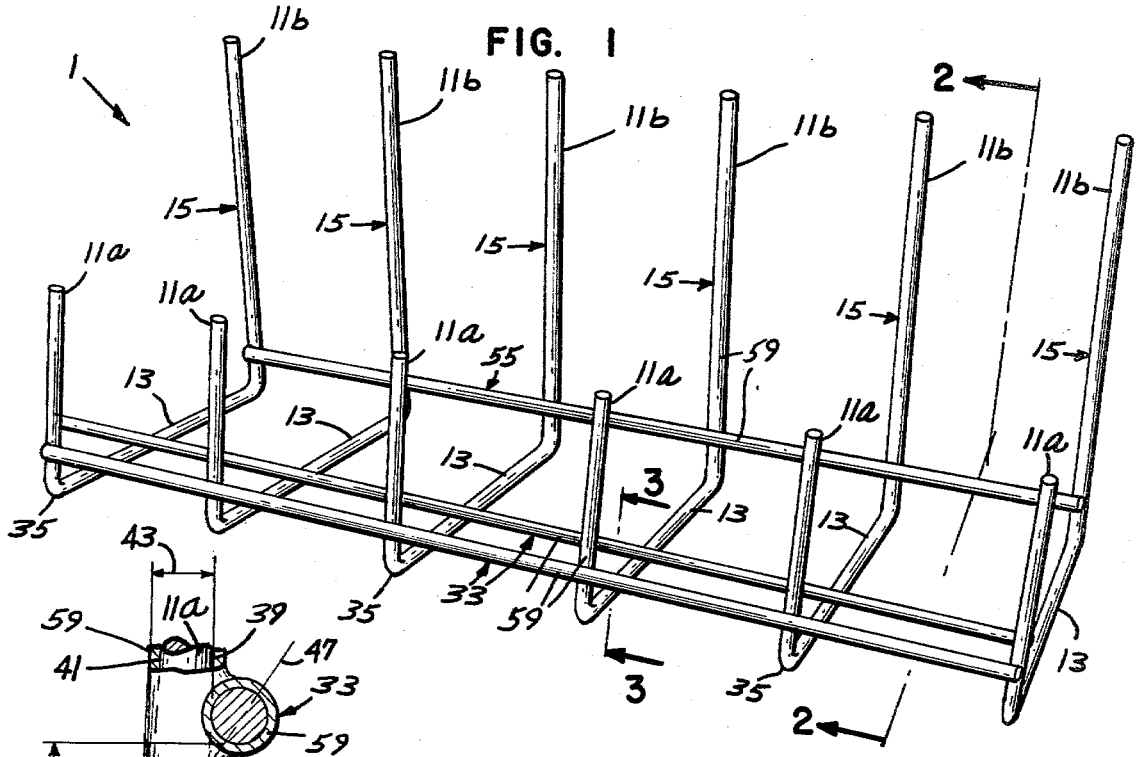
FIG. 1 is a perspective view of the baby bottle assembly component drying rack.
Figure 1:
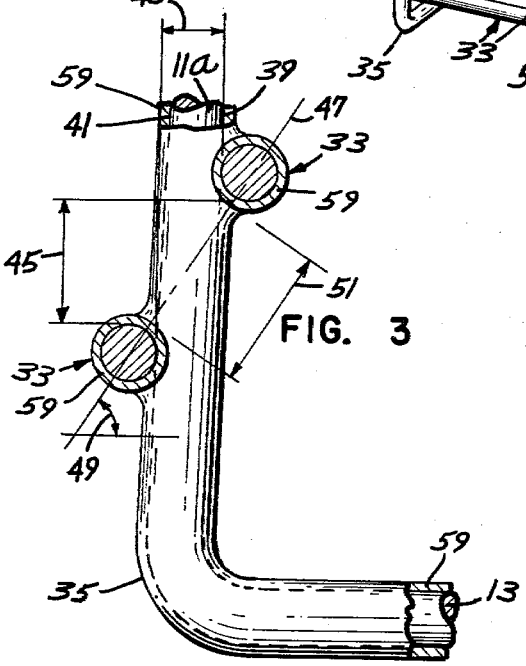
Figure 3:
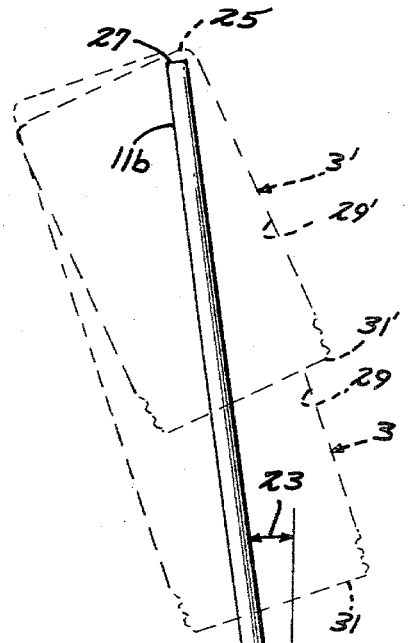
FIG. 3 is a fragmentary sectional view as seen from the line 3—3 of FIG. 1.

Referring to the figures, wherein like reference numerals denote like elements, FIG. 1 shows a rack 1 of unitary construction on which are dried various components of a baby bottle assembly. Such components, which are shown by dashed lines, normally include a bottle 3, 3', the size of which may vary, a nipple 5, a plug disc 7, and a threaded cap 9.

Rack 1 includes a plurality of generally vertical spaced elongated members **11*a*, 11*b*. In the preferred embodiment, each first arm 11*a* is paired with a second arm 11*b* by an interconnecting means or horizontal base 13 to form a generally U-shaped rod 15. U-shaped rods 15 can be manufactured with the first arm 11*a* of a length shorter than that of the corresponding second arm 11*b*. By so manufacturing, waste of materials is minimized. Rack 1 can have any number of U-shaped rods 15** depending upon the number of bottle assemblies desired to be accommodated.

Figure 2:
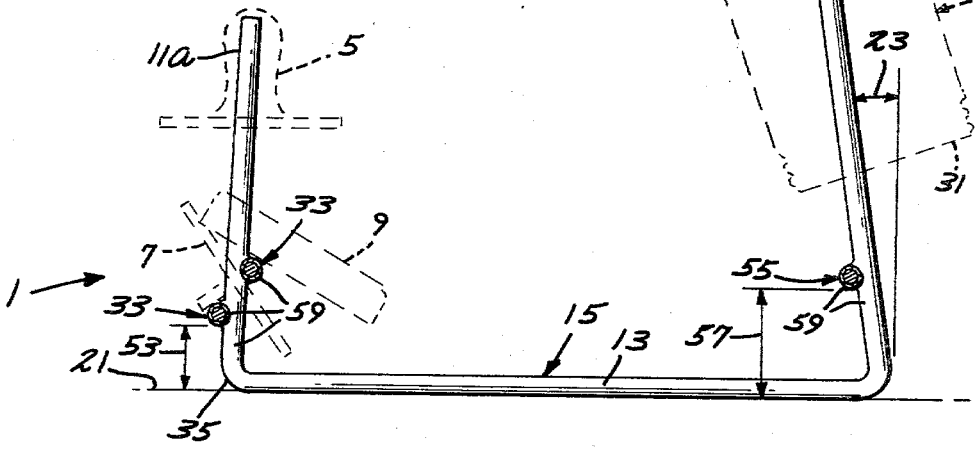
FIG. 2 is a sectional view as seen from the line 2—2 of FIG. 1.

First arm **11*a* has a length allowing accommodation of a conventionally sized nipple 5 of a baby bottle; at the same time, that length insures that the nipple 5, when placed over the arm 11*a*, is elevated from a horizontal surface 21 on which the rack 1 is placed. Second arm 11*b* is manufactured with a length sufficient to accommodate even the longest of baby bottles 3, 3' available on the market. As shown in FIG. 2, second arm 11*b*, in the preferred embodiment, is canted slightly toward first arm 11*a* at an angle, shown at 23, so that when an inverted bottle 3, 3' is placed over it with some point on the circumference of the base of the bottle 25 resting on the upper end 27 of the arm 11*b*, no point on either the inner wall 29, 29' of the bottles 3, 3' or the mouth 31, 31' of the bottle 3, 3'** should come in contact with the arm. Complete drying of all surfaces of the bottle is thereby facilitated.

A pair of parallel and generally horizontal elongated members 33, shown in FIG. 1 as parallel rods, connect the generally U-shaped rods 15, such connection being accomplished by affixing the generally horizontal parallel rods to the first arm 11*a* of each U-shaped rod 15 near the bottom end 35 thereof. In the preferred embodiment, this connection is accomplished by welding horizontal rods 33 to first arm 11*a* of each U-shaped rod 15. By so doing, the rack is given form and a degree of structural integrity.

The invention is, by no means, intended to be limited to a structure wherein these generally horizontal parallel rods are linear. The invention contemplates embodiments wherein these rods may be bent to take the form of generally circular structures defining planes parallel to one another. Nor are the embodiments contemplated limited to these two specific examples. The shape which the rods may take is virtually unlimited.

One rod of the pair is affixed to an inner side 39 of first arm 11*a*, and the other horizontal rod is affixed to the outer side 41 of first arm 11*a*. This placement provides horizontal spacing, as shown at 43, of the pair. Further, the rods are vertically spaced, as shown at 45, so that a plane 47 defined by their elongation axes forms an angle 49 with respect to the horizontal. A slot 51 is defined by this positioning of horizontal rods 33, and it facilitates easy placement therein of plug discs 7. The rods 33 are positioned on first arm 11*a* at a height above surface 21, as shown at 53, so as to prevent plug discs 7 placed therebetween from coming in contact with horizontal surface 21.

Threaded caps 9 of the baby bottle assemblies can be looped over first arm 11*a*, and when so placed, the pair of parallel horizontal rods 33 further functions to prevent caps 9 from coming in contact with either bases 13 of U-shaped rods 15 or the horizontal surface 21 on which the rack 1 is placed.

A third horizontal rod 55 may be mounted connecting second arm 11*b* of each U-shaped rod 15, and at a height, as shown at 57, above the surface 21 on which the rack 1 is placed. Horizontal rod 55 serves to add an increased degree of structural integrity to the rack 1. Additionally, it also functions as a stop to prevent threaded caps 9 looped over second arms 11*b* from slipping all the way down and coming in contact with either bases 13 of U-shaped rods 15 or the horizontal surface 21. In the preferred embodiment, this rod 55 is also affixed by means of welding.

It should be made clear that welding is not the only method by which the rack 1 can be given structural integrity. Eyes can be affixed to the vertical arms at the point designated for attachment of the parallel horizontal rods. These eyes can be made so as to have a diameter the same as that of the horizontal rods to be used. The horizontal rods 33, 55 can then be threaded through these eyes in order to provide shape and structural integrity. As can easily be seen, such an embodiment would permit easy assembly and disassembly of the rack unit 1.

Additionally, it should be made clear that, although the embodiment illustrated in the figures shows a rack base formed by the bases 13 of each of the U-shaped rods 15, it need not be limited to use on a horizontal surface such as a counter. Minor structural additions will permit mounting of the rack to a wall in the vicinity of a sink area or any other vertical surface.

Although the rack 1 need not be manufactured of metal, and other materials are contemplated by the invention, metal is frequently used. When a non-metallic material is used, however, methods other than welding will be required to interconnect the various parts in assembling the structure of the preferred embodiment. When a metallic material is used, it should be coated with either a rubber or plastic substance 59 to prevent oxidation of the rods as a result of wet baby bottle components coming in contact with them.

As can be seen, after components are washed, threaded cap 9 should be placed on the rack 1 before either the nipple 5 or the bottle 3, 3', since the inner diameter of the cap 9 is not large enough to fit over either of the other two components. After the cap 9 is placed on the rack 1, the other components may be placed in their drying positions. The drying positions provided further facilitate reassembly of the bottle and components. The bottle 3, 3' may be removed from the rack 1 without obstacle for use. Access to the nipple 5 is, similarly unimpeded. Once both the bottle 3, 3' and nipple 5 are removed, there is free access to the threaded cap 9 also.

It will be observed, that, when assembly components are placed on the rack to dry, they are positioned so that all orifices and cavities are oriented downward. Water will not, therefore, remain on or in the components. Better and more complete drying is thereby facilitated.

What is claimed is:

1. A rack upon which are dried various components of a baby bottle assembly including a bottle, a nipple, a plug disc having a grasping tab with a dimension transverse to a main body portion of the disc, and a threaded cap, comprising:

a plurality of generally U-shaped rods, each of which rods includes a first generally vertical arm having a top and bottom end and a second generally vertical arm having a top and bottom end, over which arms can be looped threaded caps and upon which can be placed nipples and inverted bottles, and a horizontal base interconnecting said arms near the bottom ends thereof; and means for holding plug discs, said means including a pair of parallel and generally horizontal rods, the first of said generally horizontal rods affixed on the interior side of the first arm of each of said U-shaped rods near the base thereof, and the second of said generally horizontal rods affixed on the exterior side of the first arm of each of said U-shaped rods and spaced from said first of said generally horizontal rods a distance less than the transverse dimension of a plug disc grasping tab so as to define a slot in which plug discs can be received.

2. The rack of claim 1 wherein first generally vertical arms are shorter in length than second generally vertical arms.

3. The rack of claim 2 wherein said generally U-shaped rods are uniformly spaced along said horizontal rods.

4. The rack of claim 3 wherein said generally U-shaped rods lie in substantially parallel vertical planes.

5. The rack of claim 1 wherein second generally horizontal rod is vertically spaced downward from first generally horizontal rod.

* * * * *